US005273084A

United States Patent [19]

Monnig

[11] Patent Number: 5,273,084

[45] Date of Patent: Dec. 28, 1993

[54] GAS FLOW CHECK VALVE FOR BOTTLE FILLING DEVICE

[75] Inventor: Leonard W. Monnig, Moncks Corner, S.C.

[73] Assignee: Figgie International Inc., Willoughby, Ohio

[21] Appl. No.: 859,876

[22] Filed: Mar. 30, 1992

[51] Int. Cl.[5] ..... B65B 31/00

[52] U.S. Cl. ..... 141/39; 141/46; 141/303; 141/308

[58] Field of Search ..... 141/6, 39, 40, 44–47, 141/50, 51, 54, 57, 59, 62, 302, 303, 307, 308

[56] References Cited

U.S. PATENT DOCUMENTS

| | | | |
|---|---|---|---|
| 1,308,101 | 7/1919 | Oftedahl | 141/303 X |
| 2,794,453 | 6/1957 | Grosbois | 141/39 |
| 3,090,408 | 5/1963 | Naecker | 141/57 |
| 3,211,192 | 10/1965 | Van Zyl | 141/39 |
| 3,263,711 | 8/1966 | Laub | 141/47 X |
| 4,363,339 | 12/1982 | Puskarz | 141/39 |

*Primary Examiner*—J. Casimer Jacyna

*Attorney, Agent, or Firm*—Renner, Kenner, Greive, Bobak, Taylor & Weber

[57] ABSTRACT

A gas flow check valve for a bottle filling device employs a piston received within a bore which is maintained at the bottom of the filling head vent tube. The piston has a head thereon which is interposed within the flow path of escaping gas during the filling operation. The escaping gas impinges upon the underside of the head and urges the same toward a sealing position. An opposite end of the piston extends downwardly into the bottle being filled. When the level of the beverage within the bottle reaches the bottom of the piston, the buoyancy of the piston, coupled with the forces of the escaping gas impinging upon the piston head urge the piston into sealing engagement, terminating the escape of gas and similarly terminating the inward flow of beverage or liquid, terminating the filling operation.

9 Claims, 1 Drawing Sheet

GAS FLOW CHECK VALVE FOR BOTTLE FILLING DEVICE

TECHNICAL FIELD

The invention herein resides in the art of bottle filling devices and particularly those for use with counter pressure bottle filling machines. More specifically, the invention relates to a gas flow check valve for the vent tube associated with each of the filling heads employed in such machines. The gas flow check valve limits entry of liquid into the vent tube, assures positive shut off of the filling head, and precludes foaming by minimizing the amount of liquid which can be reintroduced into the bottle while depressurizing or by eliminating transfer of liquid from one bottle to another during the filling operation.

BACKGROUND ART

It has previously been well known to employ counter pressure bottle filling machines for purposes of filling bottles or other containers with liquids such as beverages and the like. The structure of such filling machines, including the multiple filling heads typically employed therewith, are well known and documented such as in U.S. Pat. Nos. 3,757,835, 4,688,608 and 5,088,527, all of which are assigned to the assignee of the instant application. The invention herein relates to bottle filling machines of the nature known from these prior art references, differing primarily in the structure, implementation, and operation of a gas flow check valve attached to the end of the vent tube received within the bottle during the filling operation.

It is well known that bottle filling machines typically include a reservoir of beverage or liquid having a pressure head maintained thereabove. The bottle filling machine typically has a plurality of identical bottle filling heads circumferentially spaced about the reservoir. Each bottle filling head has a resilient seal receiving and sealing the mouth of the bottle. A counter pressure tube or vent tube extends into the bottle at one end thereof, and into the pressure head at the other. The tube has openings or orifices at each of the ends, the same being selectively sealed during the operation of the bottle filling machine.

Each of the bottle filling heads employs several valve systems controlling physical movement and/or opening and closing of the passage of the counter pressure tube. As will be appreciated from reference to prior U.S. Pat. No. 3,757,835, when a bottle is received by the resilient seal, a valve at the top of the counter pressure tube allows the pressure head above the reservoir to communicate with the interior of the bottle. The resulting pressure in the bottle opens a liquid valve assembly fixed to the bottom of the counter pressure tube. This liquid valve consists of a disc fixed to the counter pressure tube and having a tapered edge adapted to reciprocatingly engage with and separate from a fixed valve seat maintained adjacent the sealing member.

A choke valve is maintained about the counter pressure tube and is opened by the pressure of the beverage and the flow of the beverage thereacross upon opening of the liquid valve. In the prior art, when the beverage in the bottle reaches the level of an aperture or apertures in the end of the counter pressure tube, the flow of the beverage stops, for back flow of the counter pressure gas through the counter pressure tube is prevented.

Immediately upon cessation of beverage flow, the choke valve closes by spring actuation. An inner tapered surface of the choke valve sealingly engages a portion of the tapered edge of the disc of the liquid valve. A closure is obtained by overlapping engagement of the parallel tapers of the choke valve and the disc of the liquid valve. This closure immediately prevents any further flow of beverage into the bottle for release of gas from the bottle. Immediately thereafter, conventional control of a lever arm moves the counter pressure tube downwardly, causing the disc of the fluid valve to close against its seat, allowing the bottle to be depressurized, removed, capped, and cased.

A particular problem has existed with the prior art structures discussed generally above. Particularly, the gas flow passage through the vent tube in the beverage filling valve has not been given to filling accuracy, and has tended to induce foaming of carbonated beverage during the filling operation. In the prior art, the closing of the gas flow passage through the vent tube often relied simply upon the sealing of apertures at the end of the vent tube by the rising liquid. In such systems, liquid would necessarily remain in the end of the vent tube for deposit in the bottle during depressurizing or, depending on valve closure design, into the next subsequent bottle during the filling operation, the same inducing foaming in the event of carbonated beverages, a most undesirable event. Further, the simple shutting off or sealing of the vent tube apertures has been found to be inaccurate in controlling the filling height within the bottle and has not been given to repeatability from one bottle to the next.

The prior art has also taught the implementation of a ball valve to shut off the gas flow passage through the vent tube when the beverage within the bottle reaches a desired level. However, such ball valves rely solely upon buoyancy to achieve their sealing movement and liquid or beverage is often sealed above the ball within the vent tube and remains therein for deposit in the next subsequent bottle during the filling operation, again inducing foaming. Additionally, such ball valves have typically been found to fail with respect to accuracy and repeatability because closure is dependent upon the buoyancy of the ball and the velocity of the liquid passing through the exit port of the filling valve. Such gas flow check valves have also been adversely impacted by the centrifugal forces encountered in the rotating filling machines.

DISCLOSURE OF INVENTION

In light of the foregoing, it is a first aspect of the invention to provide a gas flow check valve for a bottle filling device which provides a positive and repeatable closing of the vent tube at the end of the filling cycle.

Another aspect of the invention is the provision of a gas flow check valve for a bottle device which prevents beverage from entering the vent tube and, accordingly, precludes the deposit of the same in a subsequent bottle to be filled.

Still a further aspect of the invention is the provision of a gas flow check valve for a bottle filling device wherein closure of the valve is not totally dependent upon the buoyancy of the check device and velocity of the liquid passing through the exit port of the dispensing valve.

Yet a further aspect of the invention is the provision of a gas flow check valve for a bottle filling device wherein the valve responds to the actual level of liquid in the container and is substantially unaffected by the dynamics of the liquid flowing into the container and the centrifugal forces encountered in the rotating filling machine.

Another aspect of the invention is the provision of a gas flow check valve for a bottle filling machine in which the valve may be easily adjusted or adapted to accommodate different gas velocities resulting from different bottle configurations.

Still a further aspect of the invention is the provision of a gas flow check valve for a bottle filling device in which the checking device is maintained at the bottom of the vent tube, increasing fill height accuracy while substantially reducing foaming.

The foregoing and other aspects of the invention which will become apparent as the detailed description proceeds are achieved by the improvement of a gas flow check valve in a bottle filling device of the counter pressure filling type, having a vent tube for extension into the interior of the bottle to be filled, the check valve comprising: a housing received by the vent tube; and a piston slidingly received within said housing and movable between first and second stops, said piston selectively enabling and inhibiting communication of the vent tube with the interior of the bottle.

Yet further aspects of the invention which will become apparent herein are attained by a gas flow check valve for engagement with a vent tube of a counter pressure bottle filling device, comprising: a housing having an axial bore therethrough and radial openings passing through said housing and communicating with said bore; and a piston slidingly received within said bore, said piston sealing said bore from said openings in a first position, and allowing interconnection between said openings and said bore when in a second position.

DESCRIPTION OF DRAWING

For a complete understanding of the objects, techniques, and structure of the invention reference should be made to the following detailed description and accompanying drawing wherein.

BEST MODE FOR CARRYING OUT THE INVENTION

Figure 1:
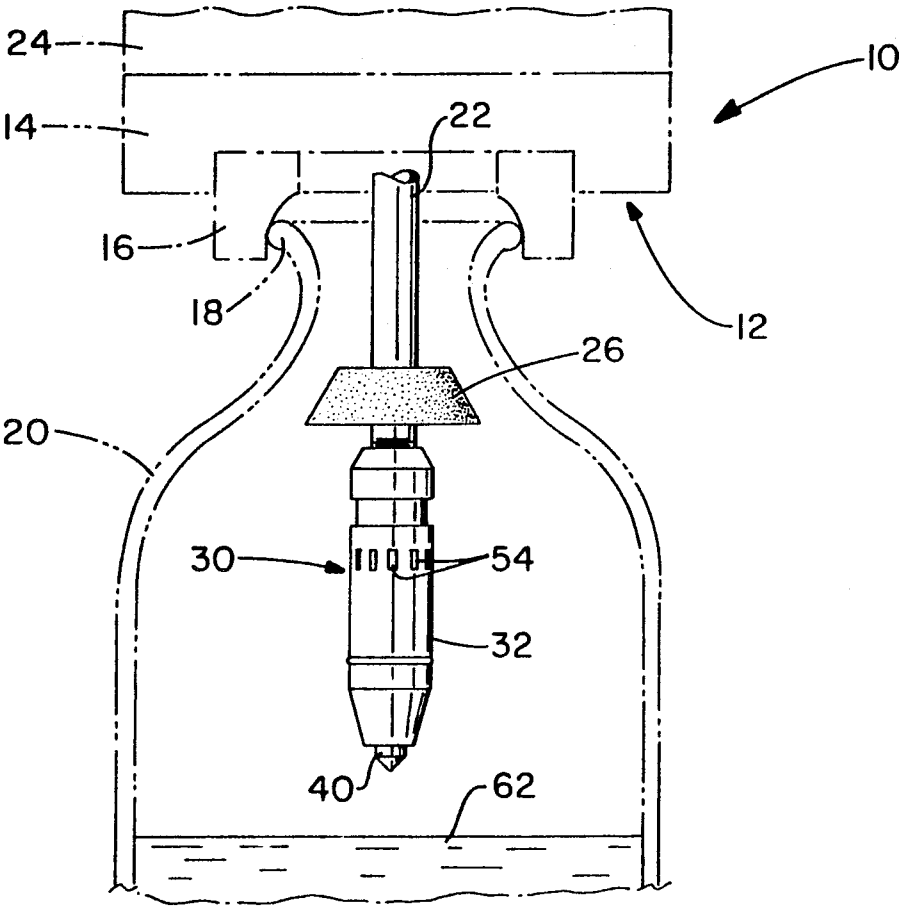
FIG. 1 is a partial cross sectional schematic illustration of a bottle filling device employing the gas flow check valve of the invention on the vent tube thereof.

Referring now to the drawing and more particularly FIG. 1, it can be seen that a bottle filling device, as generally well known and understood by those skilled in the art, is designated generally by the numeral 10. The device 10 employs a plurality of filling heads 12, typically uniformly spaced about the perimeter of a filling tank. A snift block 14, having a customary snift valve therein, receives a resilient annular seal 16 adapted for sealingly engaging the mouth or rim 18 of a bottle 20. A vent tube 22 extends from the filling valve 24 into the interior of the bottle 20 by passing axially through the resilient seal 16. Those skilled in the art will readily appreciate that the fill valve 24 would typically employ a charging valve, liquid valve, and secondary valve all of which are conventionally operated to assure proper pressurization, filling, venting, and release of the bottle 20. Finally, as in standard fashion, a spreader 26 of rubber or other suitable material is circumferentially received about the vent tube 22 for purposes of diverting beverage or liquid deposited into the interior of the bottle 20 by the filling head 12 such that the beverage passes outwardly and along the sides of the interior of the bottle 20.

The structure presented thus far is well known and understood by those skilled in the art and constitutes a portion of the prior art. Those skilled in the art understand that the structure just described is adapted to initially bring the internal pressure of the bottle 20 up to the same pressure that is inside the reservoir of the filling device by opening a charging valve. Subsequently, with the pressure in the bottle equal to the pressure in the reservoir, a liquid valve and secondary valve are opened to allow the liquid to flow down into the container. Gas within the container then escapes through the vent tube until the apertures of the vent tube are either sealed by the liquid itself or by a ball valve as discussed above.

Figure 2:
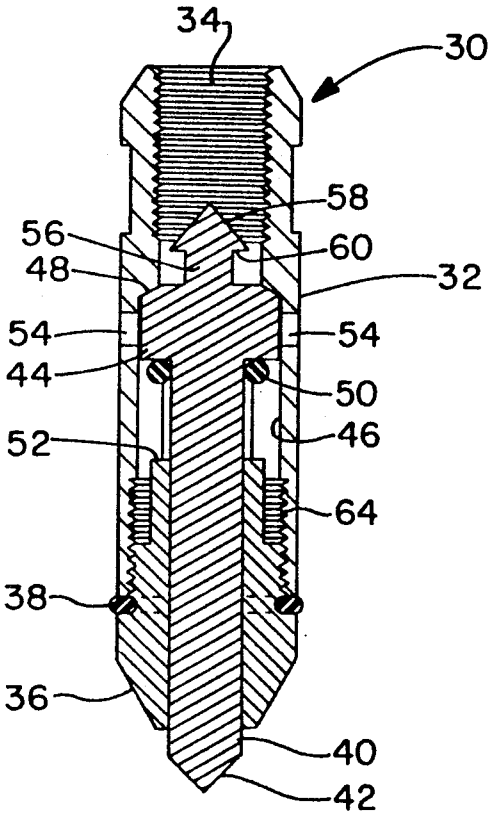
FIG. 2 is a cross sectional view of the gas flow check valve of the invention.

With reference now to FIGS. 1 and 2, it can be seen that the concept of the invention provides for the attachment of a gas flow check valve assembly 30 to the end of the vent tube 22. The assembly 30 includes a housing 32 which may be of any suitable material, but is preferably of stainless steel for safe operation in the beverage industry. The housing 32 is substantially of a cylindrical nature and is threaded at 34 to be threadedly received upon the end of the vent tube 22. A cap or plug 36 is fitted into the end of the cylindrical housing 32 opposite the threaded end 34. An O-ring seal 38 assures liquid tight engagement between the cap or plug 36 and the housing 32. The cap 36 may be fixedly secured within the housing 32, but in one embodiment of the invention it is desired that the cap 36 may be removed therefrom and replaced with caps of different configurations to accommodate the filling of various beverages at different fill rates.

A piston 40 is slidingly received within an axial bore of the cap 36 and is pointed or cone shaped at an end 42 extending from the housing 32. As shown, the opposite end of the piston 40 is maintained within the bore 46 of the housing 32. A collar 44 is positioned on the piston 40 and maintained within the bore 46 as shown. The collar 44 provides a valve interface 48 with a mating surface of the interior of the bore 46 at the housing 32. In the preferred embodiment of the invention, an outer top circumferential edge of the collar 44 is beveled or chamfered to sealingly engage a correspondingly beveled or chamfered surface of the interior of the bore 46. In FIG. 2, the valve interface is shown in its closed position.

An O-ring 50 is attached to the underside of the collar 44 and maintained about the body of the piston 40. The O-ring 50 is adapted to make contacting and restricting engagement with the top flange 52 of the cap 36. Accordingly, it will be appreciated that the movement of the piston 40 is between stops defined by the valve interface 48 and the interengagement of the O-ring 50 with the top flange 52 of the cap 36.

The housing 32 of the valve assembly 30 is characterized by a plurality of openings 54 passing radially therethrough, allowing the environment of the interior of the bottle 20 to communicate with the bore 46 of the check valve 30. Accordingly, the apertures or openings 54 allow the environment of the interior of the bottle to communicate with the vent tube when the valve interface 48 is open.

As further shown, a neck 56 extends axially upward from the collar 44 and maintains a head 58 at the end thereof. In the preferred embodiment of the invention, the head 58 is cone shaped, having a bottom flange 60 of a ring-like nature. The flange 60 is of a smaller diameter than the interior of the bore 46 to allow movement therein and to further allow escaping gas to pass thereover during the venting operation.

With an appreciation of the general structure of the gas flow check valve assembly of the invention, the operation of the same may now be discussed. It will be appreciated that when the vent tube 22 is initially placed within the interior of the bottle 20 and sealing engagement between the lip 18 and seal 16 is achieved, the piston 40 extends downward the maximum degree, restricted only by engagement of the O-ring 50 with the top flange 52 of the cap 36. At this point in time, the bottom flange 60 of the head 58 lies within a plane which is approximately coplanar with the centers of the apertures 54. Accordingly, as the interior of the bottle 20 is filled and the gas therein escapes through the apertures 54, into the bore 46, and through the vent tube 22, the escaping gas impinges upon the bottom surface of the bottom flange 60, tending to urge the piston 40 upwardly toward making of the valve interface 48. However, the escaping gas is not sufficient to lift the piston 40 to achieve such sealing engagement, but serves to reduce the effective weight of the piston 40. As the beverage 62 within the bottle 20 rises, the level eventually hits a point where it contacts the piston 40. Though the piston 40 is not itself buoyant in the liquid or beverage to the extent that it would float therein, it has sufficient buoyancy that the lift imparted to the piston 40 by the rising level of the beverage 62, coupled with the force from the gas escaping through the apertures 54 and impinging upon the bottom flange 60 is sufficient to move the piston 40 upwardly within the guide of the cap 56 to make the valve interface 48, preventing any further escaping of gas from the interior of the bottle 20, thus immediately terminating the flow of beverage into the bottle 20 and thus terminating the filling operation. In other words, as the beverage level rises within the bottle 20 and makes increasing engagement with the piston 40, the buoyant forces on the piston 40 progressively increase to the point where the force from the escaping gas impinging the bottom flange 60 is sufficient to actuate the piston into valve closing engagement at the interface 48.

It will be appreciated that the beverage or liquid 62 has only contacted the lower portion of the piston 40, and has not made contact with the vent tube 22 and, accordingly, minimal beverage remains therein for return to the same bottle upon depressurization or, dependent on valve design, for deposit into a subsequent bottle. It will further be appreciated that the valve seal is made at the valve interface 48 between the tapered surfaces of the collar 44 and the interior of the bore 46. Further sealing is achieved by the fact that the collar 44 is, in the sealed position, in blocking juxtaposition with the apertures 54.

The drawing illustrates the apertures 54 as being aligned with the collar 44 of the piston 40 when the piston is in its sealed position as shown in FIG. 2. However, it is contemplated as a portion of the invention that the number of apertures 54 may be decreased from that shown in FIG. 1, and the size of each of the apertures may be greatly increased. By way of example, it is contemplated that three apertures 54 may be uniformly spaced about the circumference of the housing 32 with such apertures being of increased length so as to extend from a point in alignment with the O-ring 50 to the top of the threads 64 as shown in FIG. 2. The number, size, and positioning of the apertures 54 may vary. It is, however, important that the bottom flange 60 be interposed in the flow path of the escaping gas to impart a lifting force to the piston 40 as discussed above.

Those skilled in the art will appreciate that the positioning of the piston 40 within the bottle determines the fill height of the bottle, and does so in a highly accurate and repeatable fashion. Since the response time of the piston 40 with respect to the filling operation must be tailored to the beverage or liquid being dispensed and its dispensing rate, it is contemplated as a portion of the instant invention that various caps 36 may be employed to allow the piston 40 to extend varying degrees into the interior of the bottle 20. It will be readily appreciated that the distance separating the top flange 52 of the cap 36 and the O-ring 50 determines the amount of extension of the piston 40 into the bottle 20. Accordingly, if the liquid being filled or the filling rate is changed, the caps 36 may be similarly removed and changed such that the piston 40 is properly positioned within the receiving bottles 20 so that the valving action takes place at the proper time to assure an accurate fill. This position will be dependent upon the nature of the liquid and the relative buoyancy of the piston 40 with respect thereto, as well as the filling rate of the liquid. The caps 36 may be interchanged by simple removal and replacement, or by an adjustability feature which may be easily accomplished by threadedly engaging the caps 36 in the end of the housing 32 at 64.

It should also be appreciated that the implementation of the piston 40 within a guide bore of the cap 36 eliminates the random movement of the ball type check devices previously known in the art and the cone shaped head 58 with the bottom flange 60 allows the venting gas to assist in the raising of the piston which was previously accomplished solely by buoyancy in the prior art. The cone shape of the head 58 further provides for laminar flow of the escaping gas over the head and into the vent tube 22. Filling accuracy is improved by allowing the piston 40 of the check valve 30 to respond to the actual level of liquid in the container, substantially ignoring the dynamics of the liquid flowing into the container and the centrifugal forces encountered in rotating filling machines. Foaming is substantially reduced because of the more positive checking or stopping of gas and liquid flow which reduces the amount of liquid entering the vent tube.

As a further benefit of the invention, the valve assembly 30 assists in centering of the bottle 20 within the assembly and reduces the possibility of damaging the mouth or lip 18 which might otherwise occur when the valve is misaligned. Particularly, the cone-shaped end 42 of the piston 40 assists with such alignment and damage prevention. Finally, by locating the checking device at the bottom of the vent tube, fill height accuracy is increased by eliminating the influence of liquid level in the filler bowl.

Thus it can be seen that the objects of the invention have been satisfied by the structure presented above. While in accordance with the patent statutes only the best mode and preferred embodiment of the invention has been presented and described in detail, it will be understood that the invention is not limited thereto or thereby. Accordingly, for an appreciation of the true scope and breadth of the invention reference should be made to the following claims.

What is claimed is:

1. In a bottle filling device of the counter pressure filling type, having a vent tube for extension into the interior of a bottle to be filled, the improvement of a gas flow check valve, comprising:

a housing received by the vent tube;

a piston slidingly received within said housing and movable between first and second stops, said piston selectively enabling and inhibiting communication of the vent tube with the interior of the bottle, said housing having openings through which said communication between the vent tube and the interior of the bottle is achieved; and wherein said piston has a head extending from an upper end of said piston, said head having a bottom flange, and a gas flow path is defined from the interior of the bottle, through said openings, and into the vent tube, said bottom flange being interposed in said gas flow path when said piston engages said second stop, gas movement in said gas flow path engaging said bottom flange and urging said piston toward said first stop, and wherein a lower end of said piston extends from said housing and is positioned to engage a rising level of fluid in the bottle during a filling operation, said engagement of said piston by the fluid, combined with said engagement of said gas movement with said bottom flange, actuating sealing engagement of said piston with said first stop.

2. The improvement in a bottle filling device according to claim 1, wherein said head is cone shaped.

3. The improvement in a bottle filling device according to claim 1, wherein said piston has a collar adapted to sealingly engage said first stop.

4. The improvement in a bottle filling device according to claim 3, wherein said collar blocks said openings when engaged with said first stop, and exposes said openings when engaged with said second stop.

5. A gas flow check valve for engagement with a vent tube of a counter pressure bottle filling device, comprising:

a housing having an axial bore therethrough and radial openings passing through said housing and communicating with said bore; and a piston slidingly received within said bore, said piston sealing said bore from said openings in a first position, and allowing interconnection between said openings and said bore when in a second position, said piston having a collar sealingly engaging an interior surface of said bore when said piston is in said first position and a flange axially spaced from said collar, said flange interposed in a gas flow path between said openings and said axial bore when said piston is in said second position, gas movement in said gas flow path engaging said flange and biasing said piston toward said first position, said piston having a first end extending from said housing and positioned to engage a rising fluid in a bottle receiving the check valve, said fluid contact and said biasing moving said piston to said first position.

6. The gas flow check valve according to claim 5, wherein said piston further comprises a head extending from said flange at a second end of said piston.

7. The gas flow check valve according to claim 6, wherein said collar is radially aligned with said openings when said piston is in said first position.

8. The gas flow check valve according to claim 7, wherein said head is cone-shaped.

9. The gas flow check valve according to claim 8, wherein an end of said housing is threaded for engagement with said vent tube.

* * * * *